US009140431B1

(12) United States Patent
Lee

(10) Patent No.: US 9,140,431 B1
(45) Date of Patent: Sep. 22, 2015

(54) LIGHTING DEVICE WITH ADJUSTING MECHANISM

(71) Applicant: Wen-Sung Lee, Taichung (TW)

(72) Inventor: Wen-Sung Lee, Taichung (TW)

( * ) Notice: Subject to any disclaimer, the term of this patent is extended or adjusted under 35 U.S.C. 154(b) by 79 days.

(21) Appl. No.: 14/197,219

(22) Filed: Mar. 5, 2014

(51) Int. Cl.

| | |
|---|---|
| ***F21V 13/04*** | (2006.01) |
| ***F21K 99/00*** | (2010.01) |
| ***F21V 14/06*** | (2006.01) |
| *F21Y 101/02* | (2006.01) |

(52) U.S. Cl.
CPC ..... *F21V 13/045* (2013.01); *F21K 9/30* (2013.01); *F21V 14/065* (2013.01); *F21Y 2101/02* (2013.01)

(58) Field of Classification Search
CPC ... F21Y 2101/02; F21V 13/045; F21V 13/06; F21V 17/02; F21V 19/02; F21V 14/06; F21V 14/065; F21V 14/045; F21K 9/30
See application file for complete search history.

(56) References Cited

U.S. PATENT DOCUMENTS

| | | | | |
|---|---|---|---|---|
| 6,290,368 | B1 * | 9/2001 | Lehrer | 362/187 |
| 6,866,401 | B2 * | 3/2005 | Sommers et al. | 362/268 |
| 7,192,165 | B2 * | 3/2007 | Petzl et al. | 362/319 |
| 7,461,945 | B2 * | 12/2008 | Shiau | 362/187 |
| 8,371,710 | B2 * | 2/2013 | Gupta et al. | 362/188 |
| 8,746,920 | B2 * | 6/2014 | Chen | 362/188 |
| 8,840,273 | B2 * | 9/2014 | Sooferian | 362/280 |
| 9,028,100 | B2 * | 5/2015 | Li et al. | 362/277 |

* cited by examiner

*Primary Examiner* — Bao Q Truong

(57) ABSTRACT

A lighting device includes a lighting module and a focusing module. The lighting module has a body and a barrel. The body has a base at one side to couple with the barrel and a light source on the base. The barrel has a pair of inclined grooves in an inner periphery thereof. The focusing module has a reflecting cup and a focusing member. The reflecting cup has a pair of slots horizontally disposed therein. The focusing member has a focusing lens corresponding to the light source and two bolts extending from opposite sides of the focusing lens. Each of the two bolts passes through the respective slot of the reflecting cup and movably inserted in the respective inclined groove of the barrel with one end such that rotational movement of the barrel drives the focusing member to move horizontally along the slots of the reflecting cup.

7 Claims, 9 Drawing Sheets

LIGHTING DEVICE WITH ADJUSTING MECHANISM

BACKGROUND OF THE INVENTION

1. Field of the Invention

The present invention relates to a lighting device and more particularly to a lighting device with an adjusting mechanism which is configured to adjust an illuminating range.

2. Description of Related Art

A conventional lighting device with a focusing mechanism comprises a lighting module and an adjusting module. The lighting module has a base and a light source disposed on the base. The adjusting module has a barrel, a convex lens and a position member. The convex lens is mounted to the barrel and retained by the position member. Specifically, the base has an external thread defined at an outer periphery thereof. The barrel has an internal thread defined at an inner periphery thereof and corresponding to the external thread of the base. With the internal thread of the barrel and the external thread of the base, the barrel could be assembled with the base and rotated relative to the base so as to adjust a distance between the convex lens and the light source.

Accordingly, a user could rotate the barrel to move the barrel back and forth relative to the base to adjust an illuminating range, while the convex lens is moving backward or forward to increase or spotlight the illuminating range. However, the internal thread of the barrel and the external thread of the base are relative high manufacturing cost.

The present invention has arisen to mitigate and/or obviate the disadvantages of the conventional lighting device.

SUMMARY OF THE INVENTION

The main objective of the present invention is to provide an improved lighting device with an adjusting mechanism.

To achieve the objective, a lighting device comprises a lighting module and a focusing module. The lighting module has a body and a barrel. The body has a base at one side to couple with the barrel and a light source on the base. The barrel has a pair of inclined grooves in an inner periphery thereof at opposite sides. The focusing module has a reflecting cup and a focusing member. The reflecting cup is attached to the base of the body around the light source and received in the barrel. The reflecting cup has a pair of slots horizontally disposed therein. The focusing member has a focusing lens corresponding to the light source and two bolts extending from opposite sides of the focusing lens, wherein each of the two bolts passes through the respective slot of the reflecting cup and is movably inserted in the respective inclined groove of the barrel with one end such that rotational movement of the barrel drives the focusing member to move horizontally along the slots of the reflecting cup.

Specifically, the focusing member is movable between a first position in which each of the two bolts is located in one end of the respective slot, and a second position in which each of the two bolts is located in an opposite end of the respective slot so as to adjust a distance between the focusing member and the light source. Furthermore, the reflecting cup has two wings respectively and horizontally extending from an outer side of the reflecting cup toward the barrel; and each of the two wings has a passage communicating with the respective slot of the reflecting cup for accommodating the respective bolt of the focusing member.

Moreover, the lighting device further comprises a cap mounted around the barrel and a handle extending downward from the body. The cap has at least one positioning groove in an inner periphery thereof. The barrel has an annular groove therein and at least one protrusion defined in the annular groove for coupling with the positioning groove of the cap. The handle has a plurality of holding grooves defined around the handle.

Further benefits and advantages of the present invention will become apparent after a careful reading of the detailed description with appropriate reference to the accompanying drawings.

DETAILED DESCRIPTION OF THE INVENTION

Figure 1:
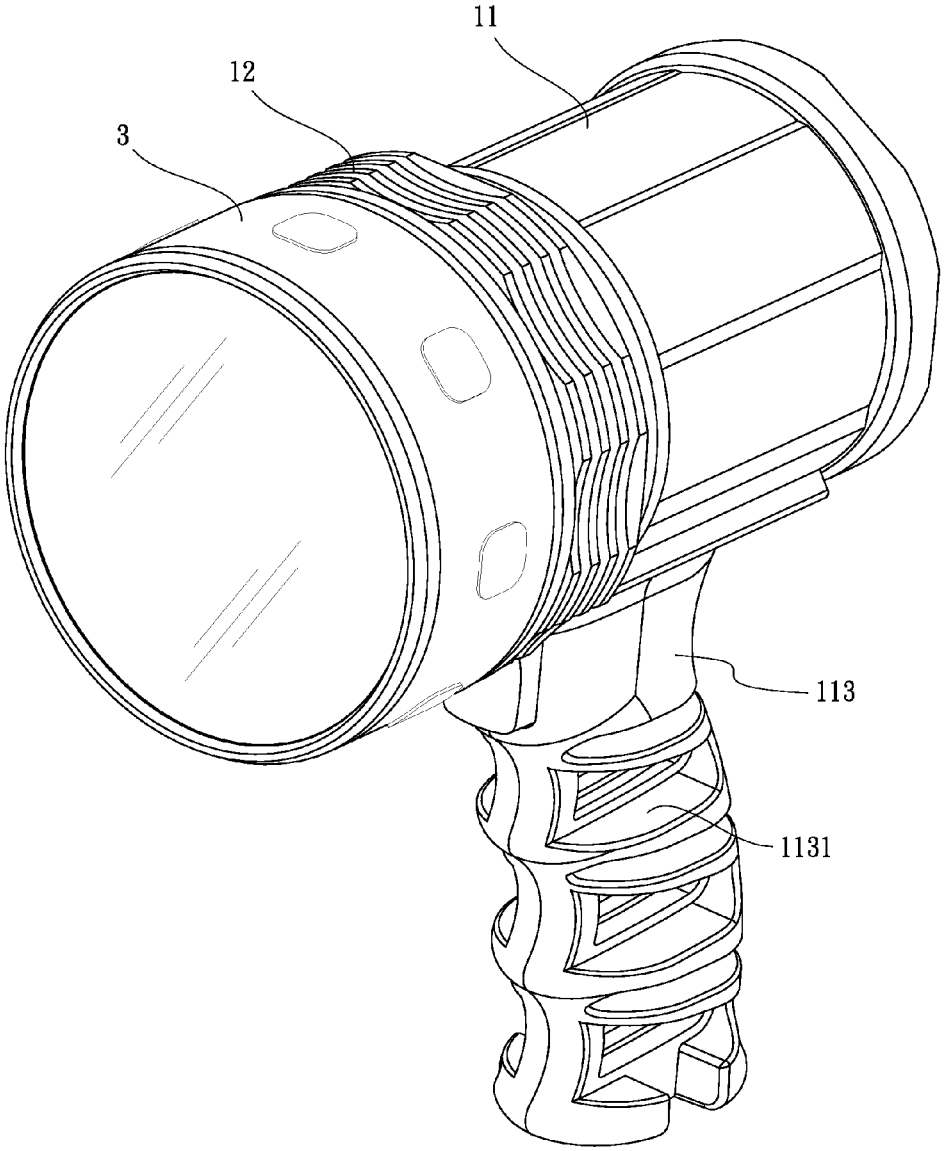
FIG. 1 is a perspective view of a lighting device of the present invention.
Figure 2:
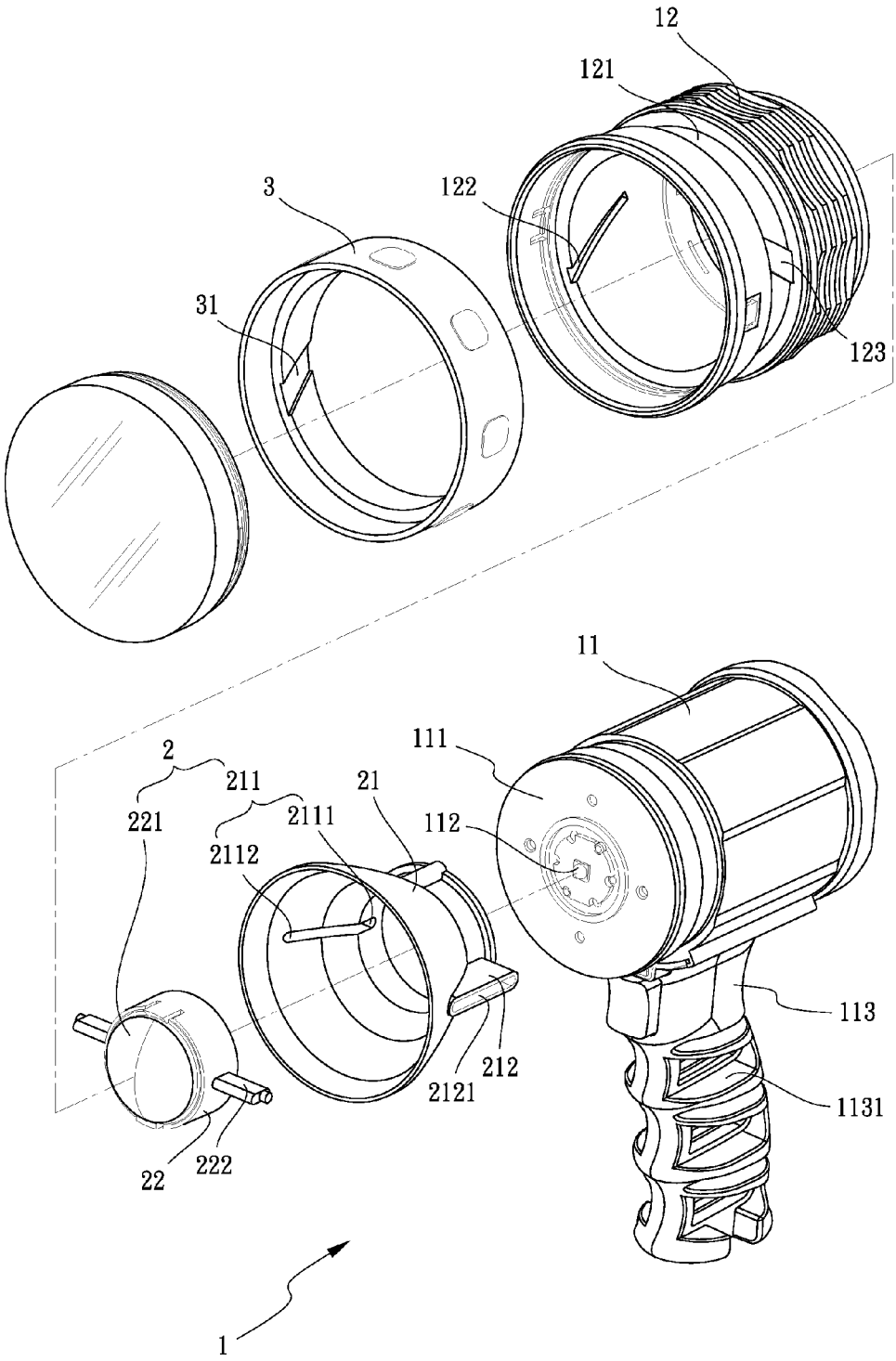
FIG. 2 is an exploded perspective view of the lighting device in FIG. 1.
Figure 3:
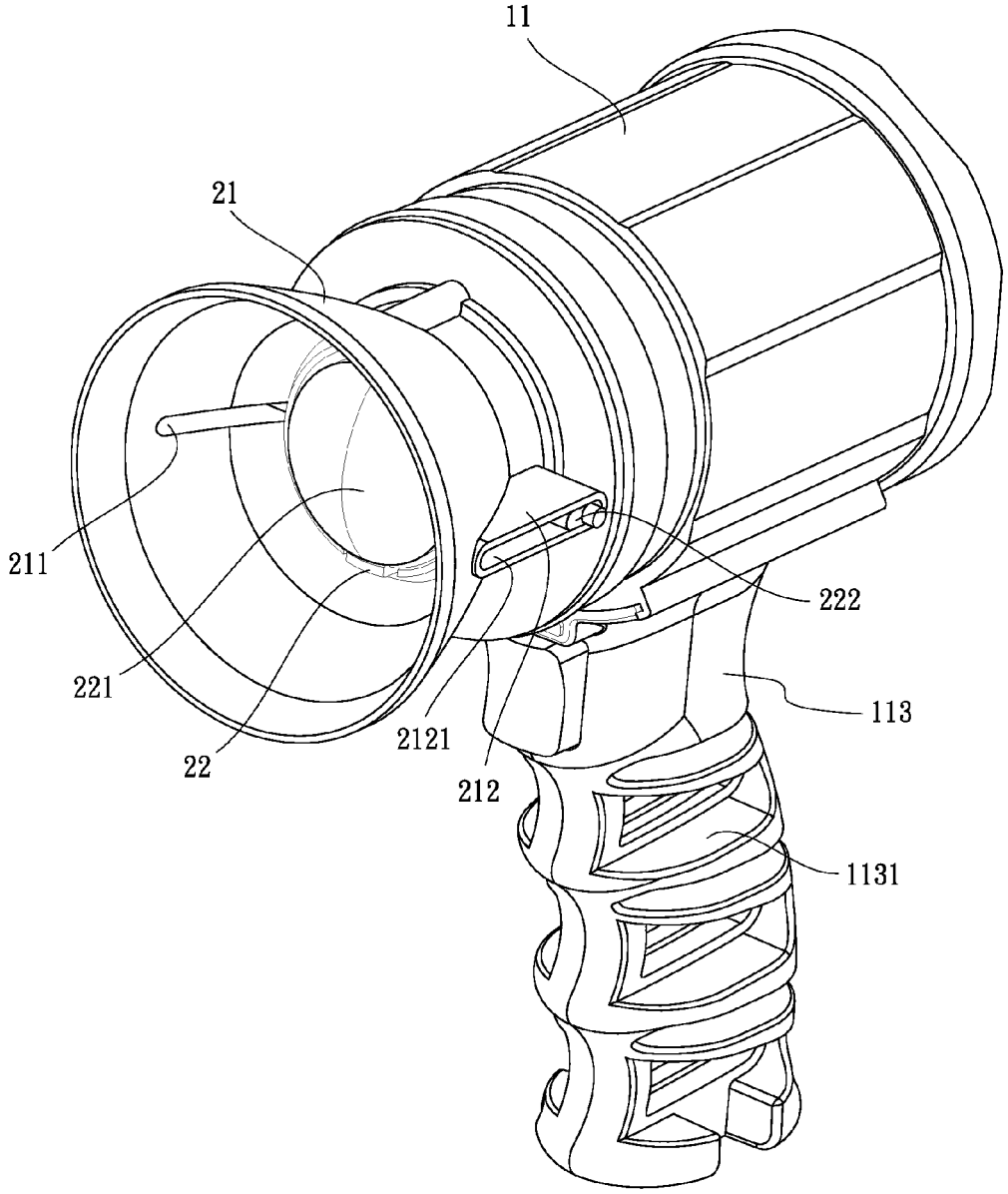
FIG. 3 is another perspective view of the lighting device in FIG. 1, wherein a barrel and a cap are detached from a base.

Referring to FIGS. 1-3, a lighting device in accordance with a preferred embodiment of the present invention comprises a lighting module 1 and a focusing module 2. The lighting module 1 has a body 11 and a barrel 12. The body 11 has a base 111 at one side to couple with the barrel 12 and a light source 112 on the base 111. The barrel 12 has a pair of inclined grooves 122 in an inner periphery thereof at opposite sides. The focusing module 2 has a reflecting cup 21 and a focusing member 22. The reflecting cup 21 is attached to the base 111 of the body 11 around the light source 112 and received in the barrel 12. The reflecting cup 21 has a pair of slots 211 horizontally disposed therein.

As shown in FIGS. 2-3, the focusing member 22 has a focusing lens 221 corresponding to the light source 112 and two bolts 222 extending from opposite sides of the focusing lens 221, wherein the focusing lens 221 is a convex lens. Each of the two bolts 222 passes through the respective slot 211 of the reflecting cup 21 and movably inserted in the respective inclined groove 122 of the barrel 12 with one end such that rotational movement of the barrel 12 drives the focusing member 22 to move horizontally along the slots 211 of the reflecting cup 21, as shown in FIGS. 4-6.

Figure 4:
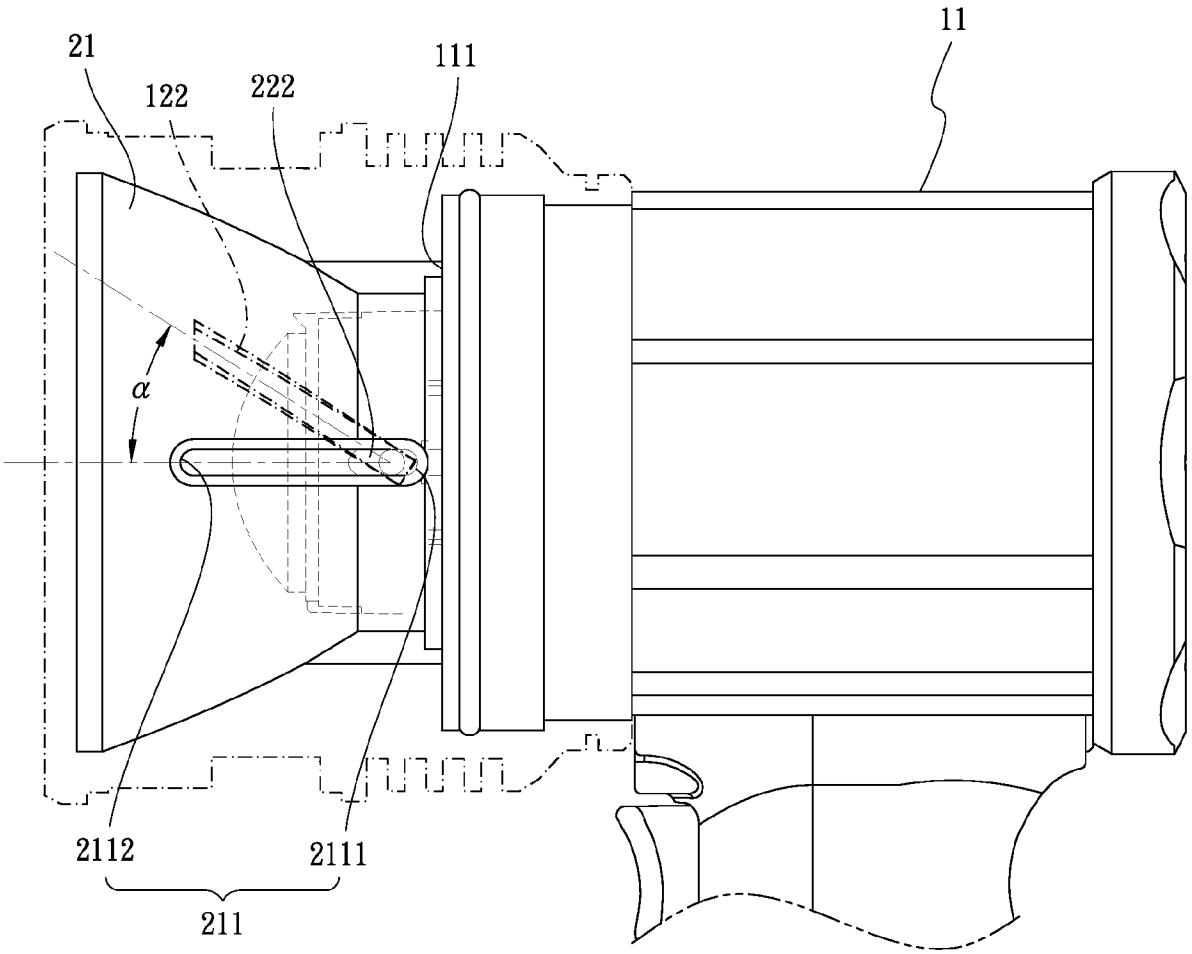
FIGS. 4-6 illustrate that a focusing member is adjusted by rotation movement of the barrel.
Figure 5:
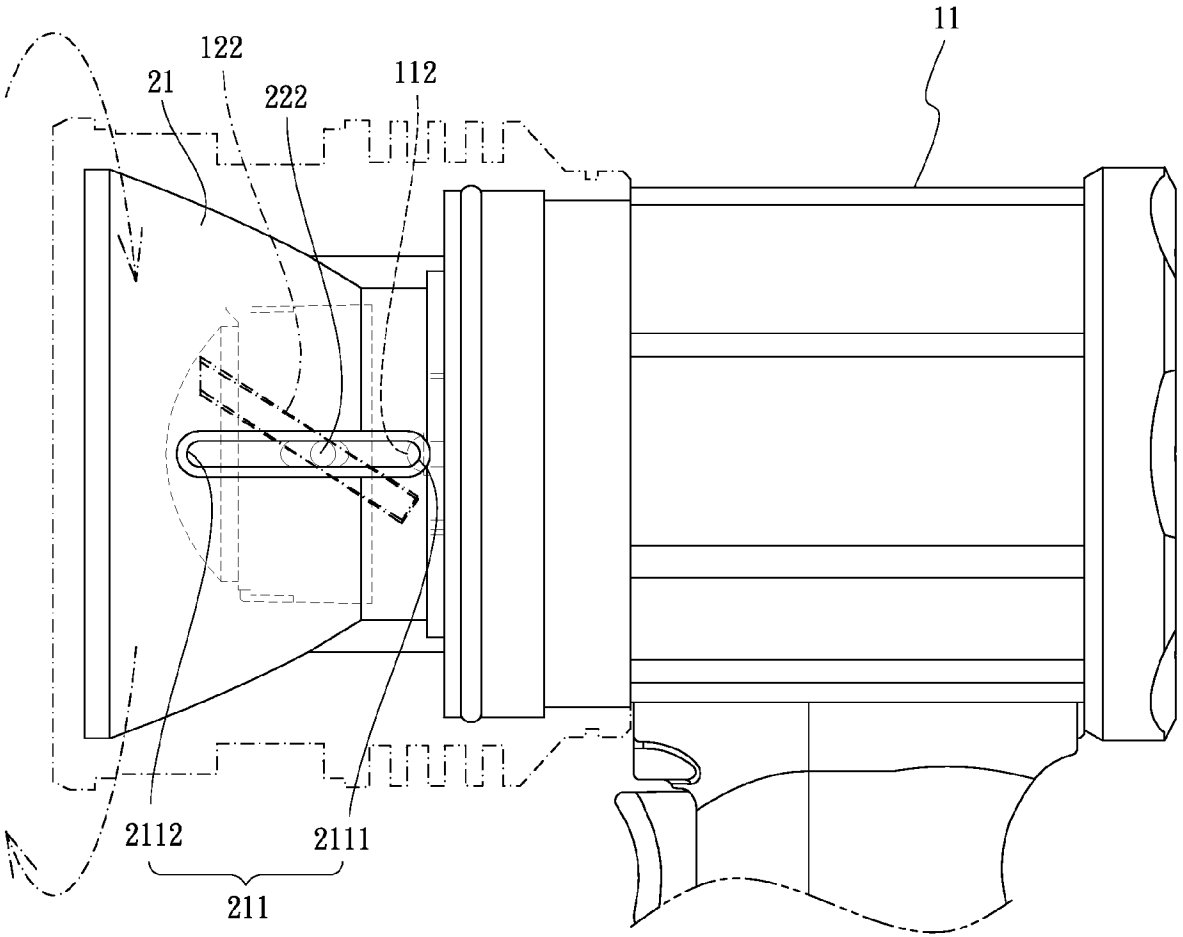
Figure 6:
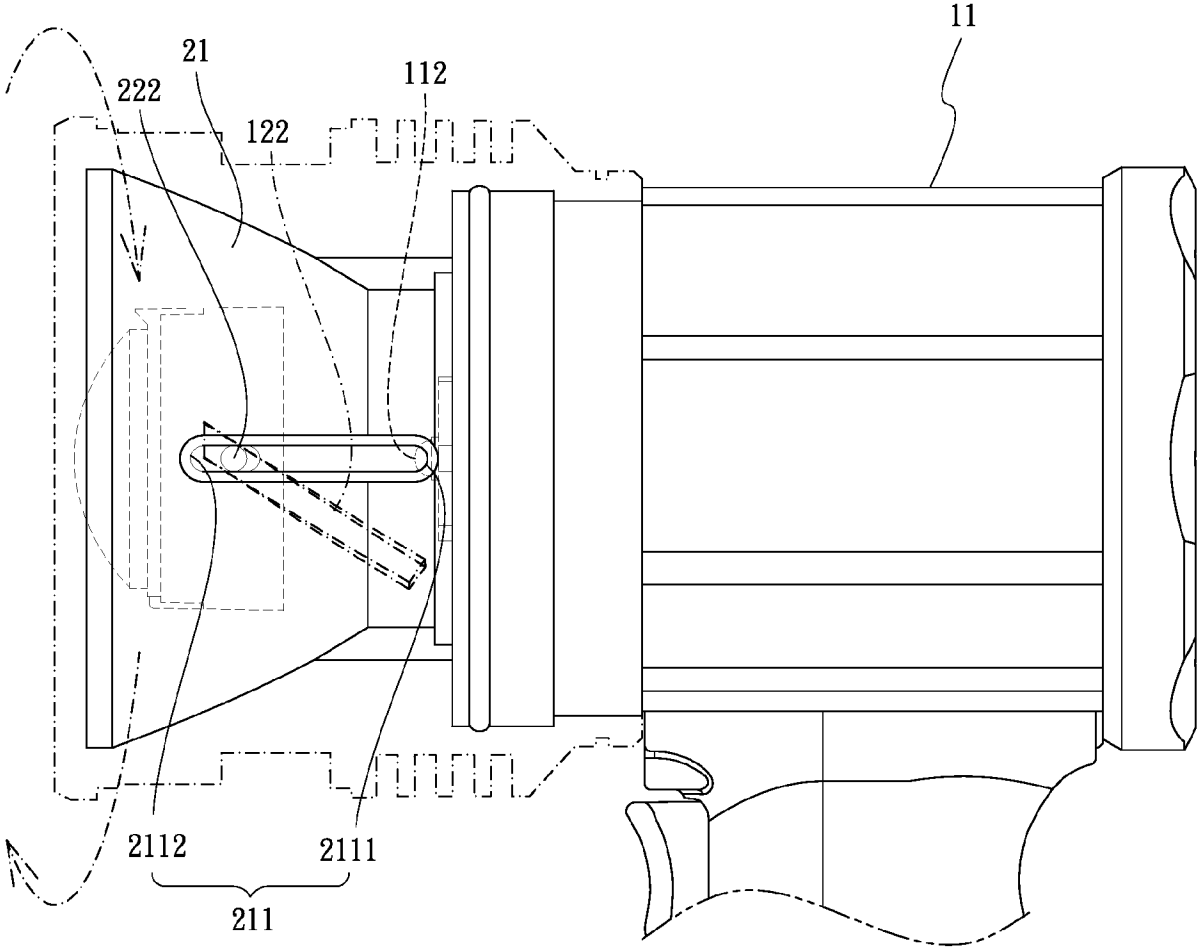
Figure 7:
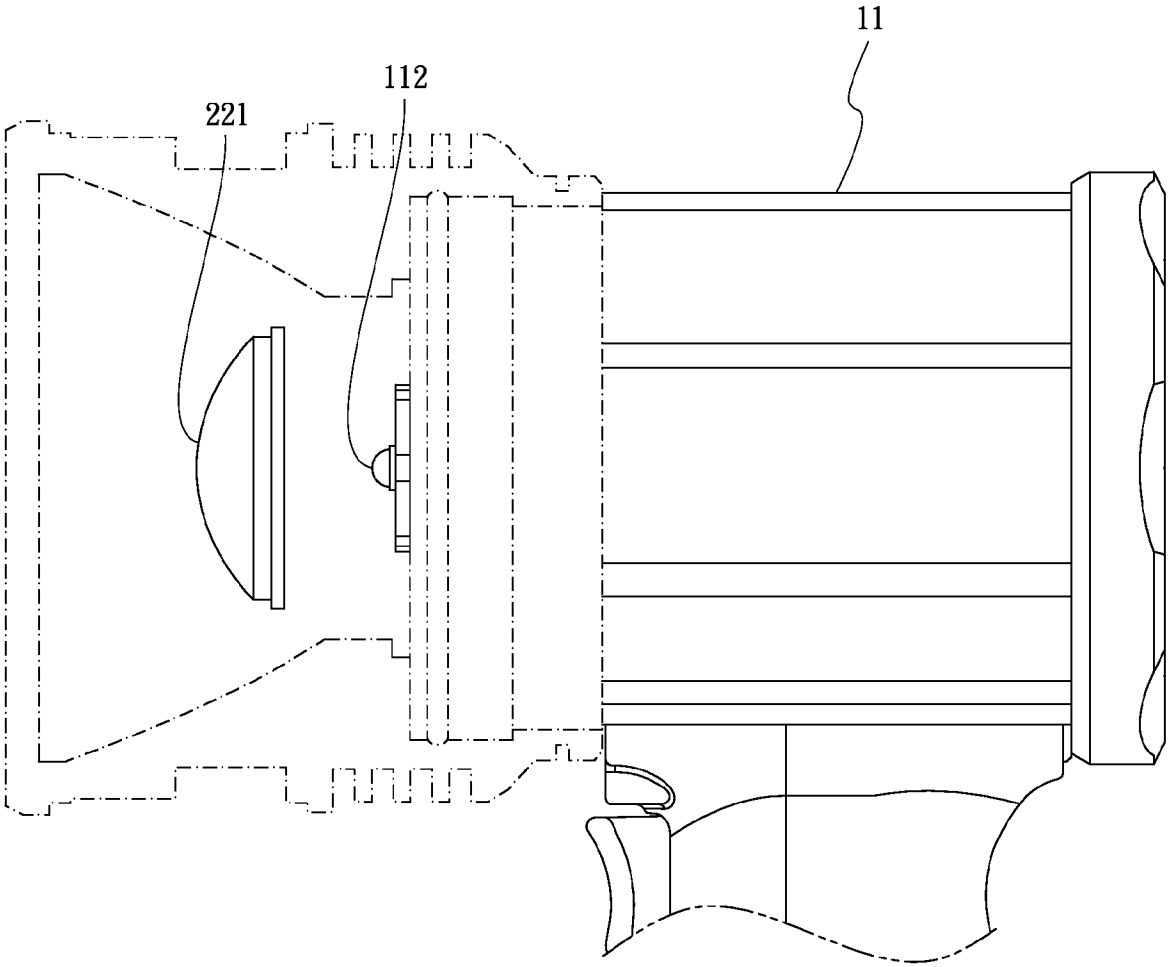
FIGS. 7-9 illustrate that a focusing lens is adjusted relative to a light source.
Figure 8:
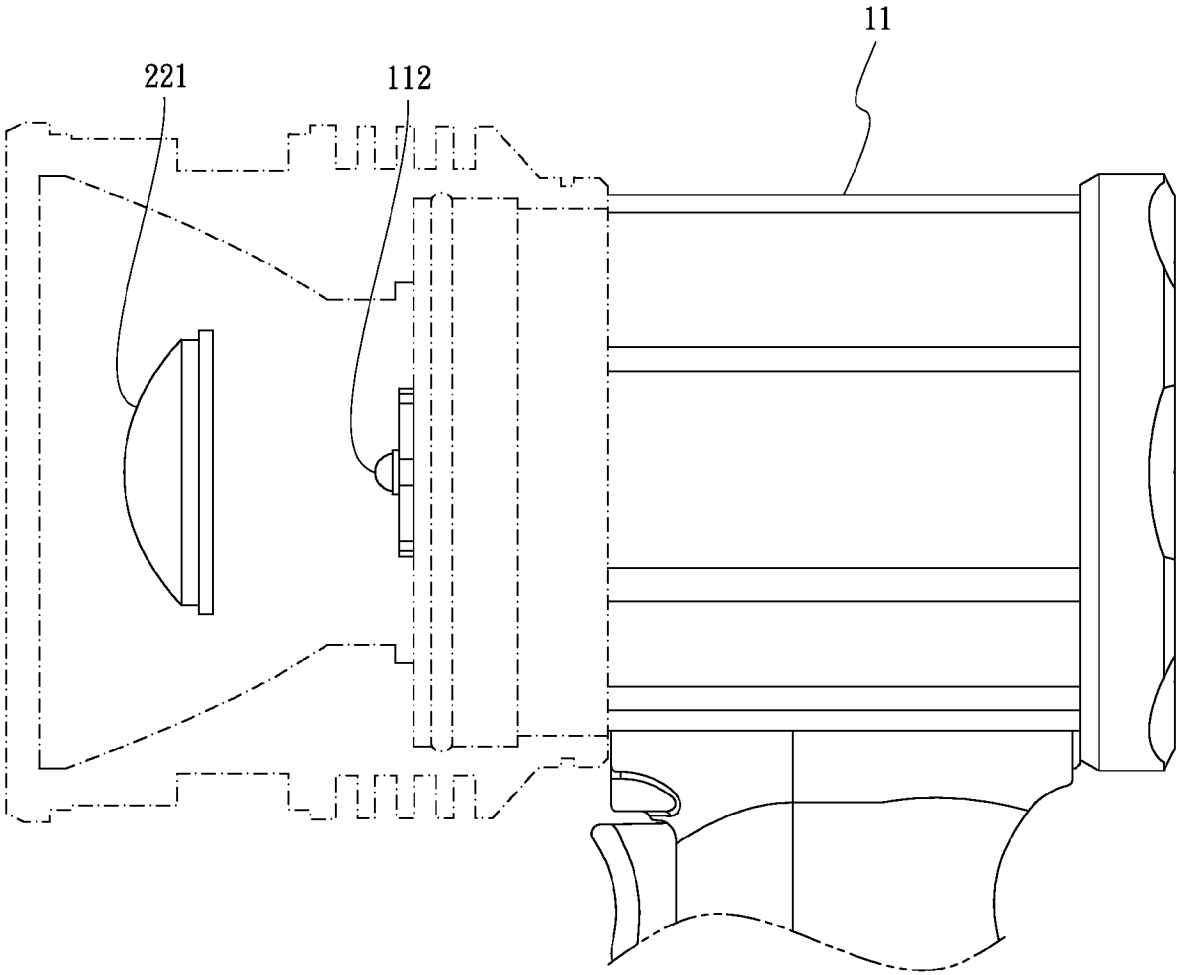
Figure 9:
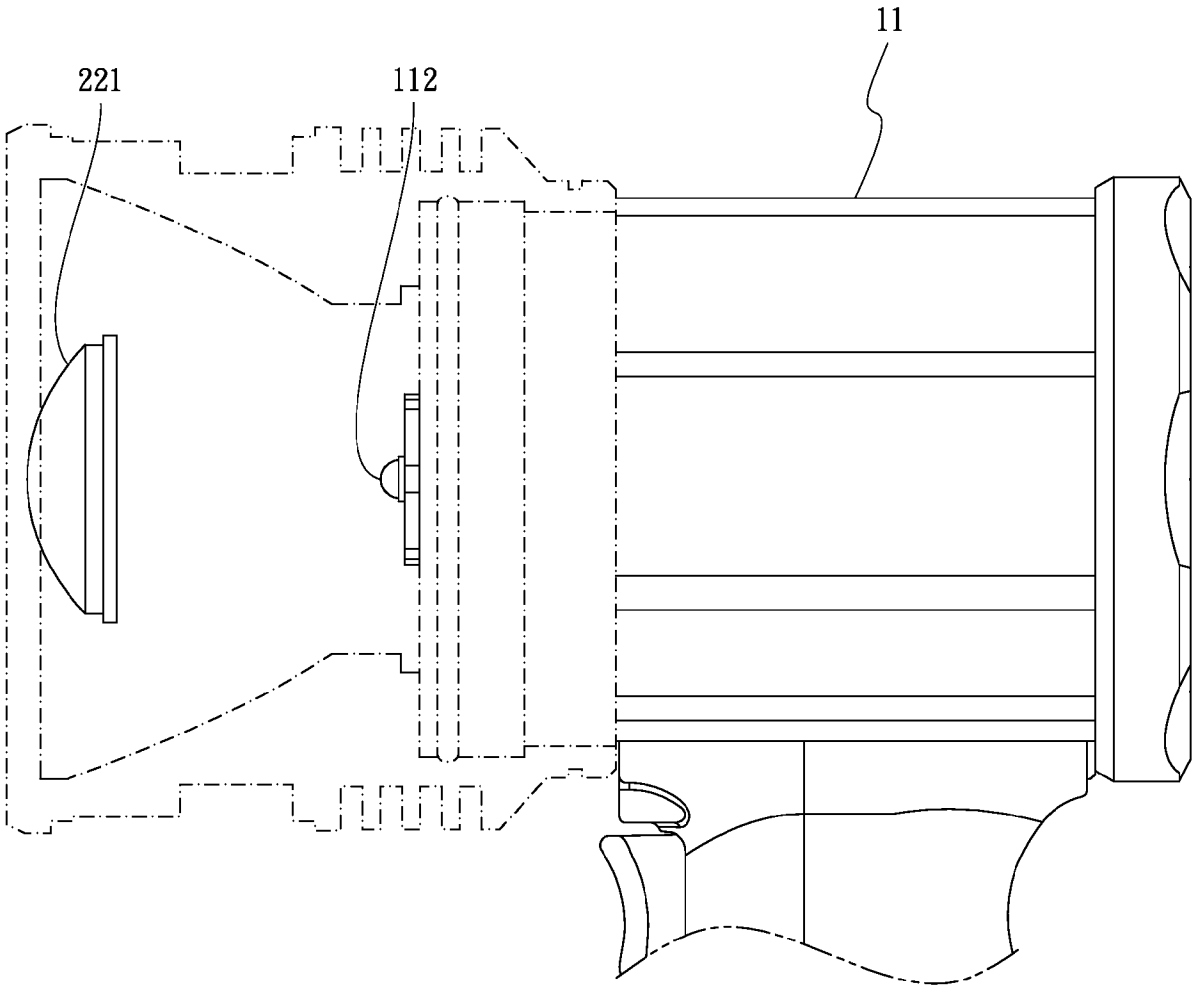

Referring to FIGS. 4-9, the focusing member 22 is movable between a first position in which each of the two bolts 222 is located in one end 2111 of the respective slot 211, and a second position in which each of the two bolts 222 is located in an opposite end 2112 of the respective slot 211 so as to adjust a distance between the focusing lens 221 and the light source 112, as shown in FIGS. 7-9. Specifically, an angle $\alpha$ is defined between each inclined groove 122 of the barrel 12 and the respective slot 211 of the reflecting cup 21, as shown in FIG. 4. Under this arrangement, the barrel 12 could be rotated to drive the focusing member 22 back and forth relative to the light source 112 to adjusting an illuminating range, while the focusing lens 221 is moving backward or forward to increase or spotlight the illuminating range.

Referring to FIGS. 2-3, the reflecting cup 21 has two wings 212 respectively and horizontally extending from an outer side of the reflecting cup 21 toward the barrel 12. Each of the two wings 212 has a passage 2121 communicating with the respective slot 211 of the reflecting cup 21 for accommodating the respective bolt 222 of the focusing member 22. Therefore, each bolt 222 could be slid smoothly within the passage 2121 of the respective wing 212.

As shown in FIGS. 1-2, a cap 3 is mounted around the barrel 12. The cap 3 has at least one positioning groove 31 in an inner periphery thereof. The barrel 12 has an annular groove 121 therein and at least one protrusion 123 defined in the annular groove 121 for coupling with the positioning groove 31 of the cap 3. Preferably, the light source 112 is a light emitting diode.

Furthermore, a handle 113 extends downward from the body 11, as shown in FIG. 1. The handle 113 has a plurality of holding grooves 1131 defined around the handle 113.

Although embodiments of this invention have been fully described with reference to the accompanying drawings, it is to be understood that various modifications can be made by those skilled in the art without departing from the scope of the invention as hereinafter claimed.

What is claimed is:

1. A lighting device, comprising:

a lighting module having a body and a barrel, the body defining a base at one side to couple with the barrel and a light source on the base, the barrel having a pair of inclined grooves in an inner periphery thereof at opposite sides; and a focusing module having a reflecting cup and a focusing member, the reflecting cup being attached to the base of the body around the light source and received in the barrel, the reflecting cup having a pair of slots horizontally disposed therein; the focusing member having a focusing lens corresponding to the light source and two bolts extending from opposite sides of the focusing lens, each of the two bolts passing through the respective slot of the reflecting cup and movably inserted in the respective inclined groove of the barrel with one end such that rotational movement of the barrel drives the focusing member to move horizontally along the slots of the reflecting cup.

2. The lighting device as claimed in clime 1, wherein the focusing member is movable between a first position in which each of the two bolts is located in one end of the respective slot, and a second position in which each of the two bolts is located in an opposite end of the respective slot so as to adjust a distance between the focusing member and the light source.

3. The lighting device as claimed in clime 1, wherein the reflecting cup has two wings respectively and horizontally extending from an outer side of the reflecting cup toward the barrel; and each of the two wings has a passage communicating with the respective slot of the reflecting cup for accommodating the respective bolt of the focusing member.

4. The lighting device as claimed in clime 1, wherein the focusing lens of the focusing member is a convex lens.

5. The lighting device as claimed in clime 1 further comprising a cap mounted around the barrel; the cap has at least one positioning groove in an inner periphery thereof; the barrel has an annular groove therein and at least one protrusion defined in the annular groove for coupling with the positioning groove of the cap.

6. The lighting device as claimed in clime 1, wherein the light source is a light emitting diode.

7. The lighting device as claimed in clime 1 further comprising a handle extending downward from the body; and the handle has a plurality of holding grooves defined around the handle.

* * * * *